US011583033B1

(12) United States Patent
Blauer

(10) Patent No.: US 11,583,033 B1
(45) Date of Patent: Feb. 21, 2023

(54) FOOTWEAR WITH A REFLECTIVE HEEL

(71) Applicant: Blauer Manufacturing Company, Inc., Boston, MA (US)

(72) Inventor: Stephen J Blauer, Lexington, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 18 days.

(21) Appl. No.: 17/008,001

(22) Filed: Aug. 31, 2020

Related U.S. Application Data

(63) Continuation-in-part of application No. 16/019,673, filed on Jun. 27, 2018, now abandoned.

(60) Provisional application No. 62/536,597, filed on Jul. 25, 2017.

(51) Int. Cl.
*A43B 21/42* (2006.01)

(52) U.S. Cl.
CPC ..... *A43B 21/42* (2013.01)

(58) Field of Classification Search
CPC ..... A43B 21/42; A43B 23/008; A43B 23/10; A43B 23/14; A43B 23/16; A43B 23/17; A43B 23/028; A43B 23/28
USPC ..... 36/137, 68, 69, 71
See application file for complete search history.

(56) References Cited

U.S. PATENT DOCUMENTS 1,952,409 A 3/1934 Berg
2,233,544 A 3/1941 McKinley
2,473,877 A 6/1949 Goldstein
2,607,130 A 8/1952 Pearson
3,527,518 A 9/1970 Tomlinson et al.
4,188,737 A * 2/1980 Haver ..... A43B 1/0036 36/131
4,233,760 A 11/1980 Haynes
4,697,362 A 10/1987 Wasserman
4,712,319 A 12/1987 Goria
4,845,863 A 7/1989 Yung-Mao
(Continued)

FOREIGN PATENT DOCUMENTS

FR 1288205 A * 3/1962 ..... A43B 1/0036

OTHER PUBLICATIONS

Wilder, Greg. "How Does Fiber Optics Work?" FiberFin, Apr. 30, 2018, https://fiberfin.com/how-does-fiber-optics-work. (Year: 2018).*
(Continued)

*Primary Examiner* — Sharon M Prange
*Assistant Examiner* — Grace Huang
(74) *Attorney, Agent, or Firm* — Altman & Martin; Steven K Martin

(57) ABSTRACT

Footwear with a reflective strip low on the heel and visible through the outsole. The reflective strip is a strip of reflective material attached horizontally to the back and, optionally, the lateral side of the footbed heel cup, positioned low on the heel cup. Optionally, the reflective strip fits into a depression in the heel cup. The reflective strip is attached to the heel cup either permanently or removably. The outsole heel and lateral side has one or more window cutouts through which the reflective strip is visible. The reflective strip is visible through the heel counter because the heel counter is either transparent, with or without raised sections filling the outsole window cutouts or has a cutout with an optional sheet of transparent protective material outside of the heel counter.

11 Claims, 8 Drawing Sheets

(56) References Cited

U.S. PATENT DOCUMENTS 5,152,082 A * 10/1992 Culpepper ..... A43B 7/20 602/65
5,381,615 A * 1/1995 MacMillan ..... A43B 1/0072 36/137
5,611,156 A 3/1997 Chiu
5,716,723 A 2/1998 Van Cleef et al.
5,799,417 A * 9/1998 Burke ..... A43B 3/0047 36/105
6,007,211 A * 12/1999 Cheung ..... G09F 13/00 362/311.03
6,023,857 A * 2/2000 Vizy ..... A43B 13/36 36/30 R
6,023,859 A * 2/2000 Burke ..... A43B 3/0047 36/100
6,112,437 A 9/2000 Lovitt
6,539,646 B2 4/2003 Brooks et al.
6,711,836 B2 * 3/2004 Weiss ..... A43B 1/0072 36/112
6,754,985 B1 * 6/2004 Lin ..... A43B 1/0036 36/100
6,775,932 B2 * 8/2004 Lin ..... A43B 1/0072 206/522
6,915,596 B2 * 7/2005 Grove ..... A43B 13/223 36/100
7,059,070 B2 6/2006 Omstead et al.
7,155,846 B2 1/2007 Alfaro et al.
7,168,188 B2 * 1/2007 Auger ..... A43B 3/0047 36/69
7,424,782 B2 * 9/2008 Cheskin ..... A43B 3/34 36/9 R
7,441,351 B2 10/2008 Clark et al.
7,451,157 B2 * 11/2008 Kaier ..... H04L 45/34
7,730,636 B2 * 6/2010 Auger ..... A43B 5/02 36/67 A
7,793,360 B2 * 9/2010 Blauer ..... A41D 13/01 2/48
7,814,687 B2 10/2010 Cook et al.
7,908,771 B2 3/2011 Foxon et al.
8,020,318 B2 * 9/2011 Khalifa ..... B29D 35/126 36/100
8,127,469 B2 * 3/2012 Keenan ..... A43B 21/28 36/37
8,286,373 B2 10/2012 Jones et al.
8,387,280 B2 * 3/2013 Grote ..... A43B 13/181 36/27
8,443,528 B2 * 5/2013 Kann ..... A43B 3/16 36/137
8,869,429 B1 * 10/2014 Zsolcsak ..... A43B 7/1445 36/2.6
9,030,085 B2 * 5/2015 Bushee ..... F41G 1/34 313/103 R
10,856,607 B2 * 12/2020 Hatfield ..... A43B 7/223
11,234,482 B2 * 2/2022 Roser ..... A43C 1/00
11,388,952 B2 * 7/2022 Nakaya ..... A43B 7/24
11,439,199 B2 * 9/2022 Schulten ..... A43B 13/186
2004/0114353 A1 6/2004 Romeo
2008/0019119 A1 * 1/2008 Marston ..... A43B 1/0072 362/103
2012/0311890 A1 * 12/2012 Berth ..... A43B 5/0411 36/107
2014/0202044 A1 * 7/2014 Adami ..... A43B 5/02 36/34 R
2014/0290098 A1 10/2014 Loverin et al.
2015/0173456 A1 * 6/2015 Rushbrook ..... A43B 5/001 36/25 R
2017/0143077 A1 * 5/2017 West ..... A43C 9/04
2021/0321718 A1 * 10/2021 Chang ..... A43B 23/16
2021/0368947 A1 * 12/2021 Wakasugi ..... A43B 23/17
2022/0132993 A1 * 5/2022 Breitholz ..... A41B 11/10 36/136

OTHER PUBLICATIONS

Office Action for U.S. Appl. No. 16/019,673 dated Nov. 12, 2019.
Office Action for U.S. Appl. No. 16/019,673 dated Mar. 3, 2020.
Advisory Action for U.S. Appl. No. 16/019,673 dated May 12, 2020.

* cited by examiner

FOOTWEAR WITH A REFLECTIVE HEEL

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to footwear, more particularly, to a shoe or boot having a reflective strip visible at the heel.

2. Description of the Related Art

Visibility is important to public safety personnel. There exists shoes and boots with reflective patches for visibility at night and in bad weather. The reflective patches tend to be on the uppers, the top, front, and sides of the footwear. Because the officer's back is more vulnerable than sides or front as the officer can see oncoming traffic, reflective patches can be found on the heel area. However, they are typically higher up on the heel counter so that they are can be inadvertently covered by the pants leg, rendering them virtually useless. Further, the heel reflective patches are on the outside of the footwear, where they can be obscured by dirt and rendered less than optimally visible by abrasion.

BRIEF SUMMARY OF THE INVENTION

The present invention is footwear with a reflective strip at the lower part of the outsole rather than the upper, so it is not covered by the pant leg. The reflective strip is inside heel counter where it is protected.

The components of the footwear (referred to hereinafter as a boot) are an upper, a heel counter, a Strobel board, an outsole, a footbed, and a reflective strip. The upper is a standard upper with the usual components.

The heel counter and forward-extending Strobel board are typically molded as a single combination but may be separate components. Typically, they are composed of a thermoplastic polyurethane that is relatively stiff at the heel counter but is more flexible at the Strobel board. The upper is Strobel stitched to the Strobel board/heel counter.

The footbed combines the functions of the midsole and insole and sits directly on the Strobel board. It has a has a heel cup and a forward section that extends to the toe. The present design of the footbed 18 provides support, cushioning, and shock absorption for the foot.

The reflective strip is an elongated strip of reflective material attached generally horizontally to the outside of the footbed heel cup. It extends around the back surface and, optionally, down the lateral side surface of the heel cup. The reflective strip is positioned low on the footbed heel cup, no more than two inches from the bottom, so that it is visible low on the heel of the boot. Contemplated methods of attachment are described below. The reflective properties are typically obtained from retroreflective glass beads or prismatic material.

The outsole is composed of a durable, flexible material. The outsole heel has window cutouts on the back and, optionally, the lateral side, through which the reflective strip is visible.

The reflective strip is visible through the heel counter. In one configuration, at least the part of the heel counter adjacent to the reflective strip is transparent. In this configuration, the heel counter protects the reflective strip from the ambient environment. Optionally, the transparent region is raised so that it fills the corresponding outsole window cutout.

Alternatively, the heel counter has a cutout through which the reflective strip is visible. Optionally, a sheet of transparent protective material is positioned outside of the heel counter to protect the reflective strip from the ambient environment.

The reflective strip can be either permanently or replaceably attached to the footbed heel cup. The reflective strip can be permanently attached in any number of ways. Permanent attachments include using an adhesive, molding the reflective strip into the footbed heel cup, permanently attaching the footbed in the boot to retain the reflective strip, and any other adequate method.

The reflective strip can be removably attached to the footbed heel cup by any adequate method. In one, the reflective strip is attached by a temporary peel-off adhesive. In another, the reflective strip is inserted into a shallow, horizontal depression. The reflective strip is retained in the depression by installing the footbed in the heel counter, whereby the heel counter presses the reflective strip into the depression.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
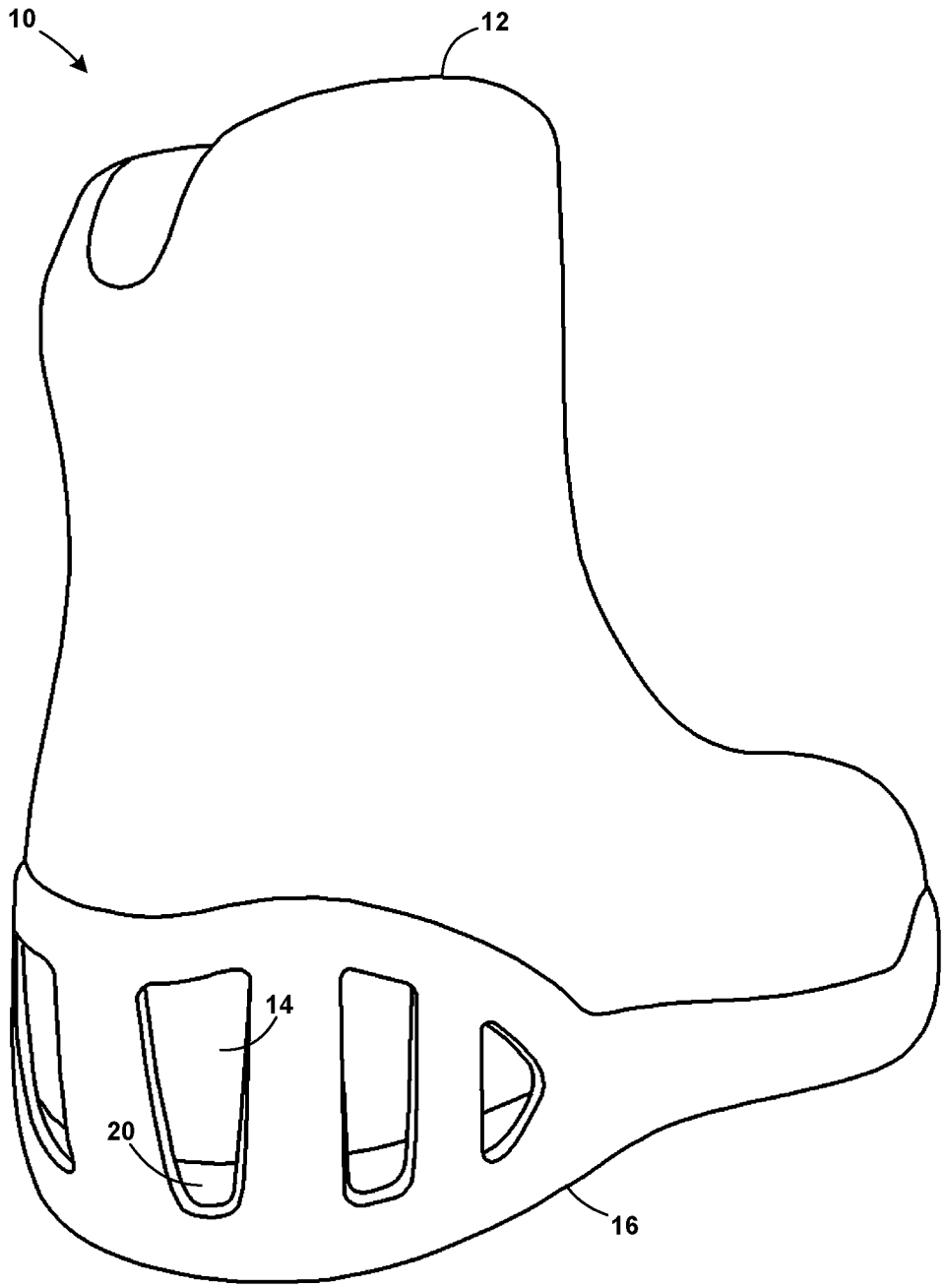
FIG. 1 is a rear, lateral, perspective view of one configuration of a boot implementing the present invention.
Figure 2:
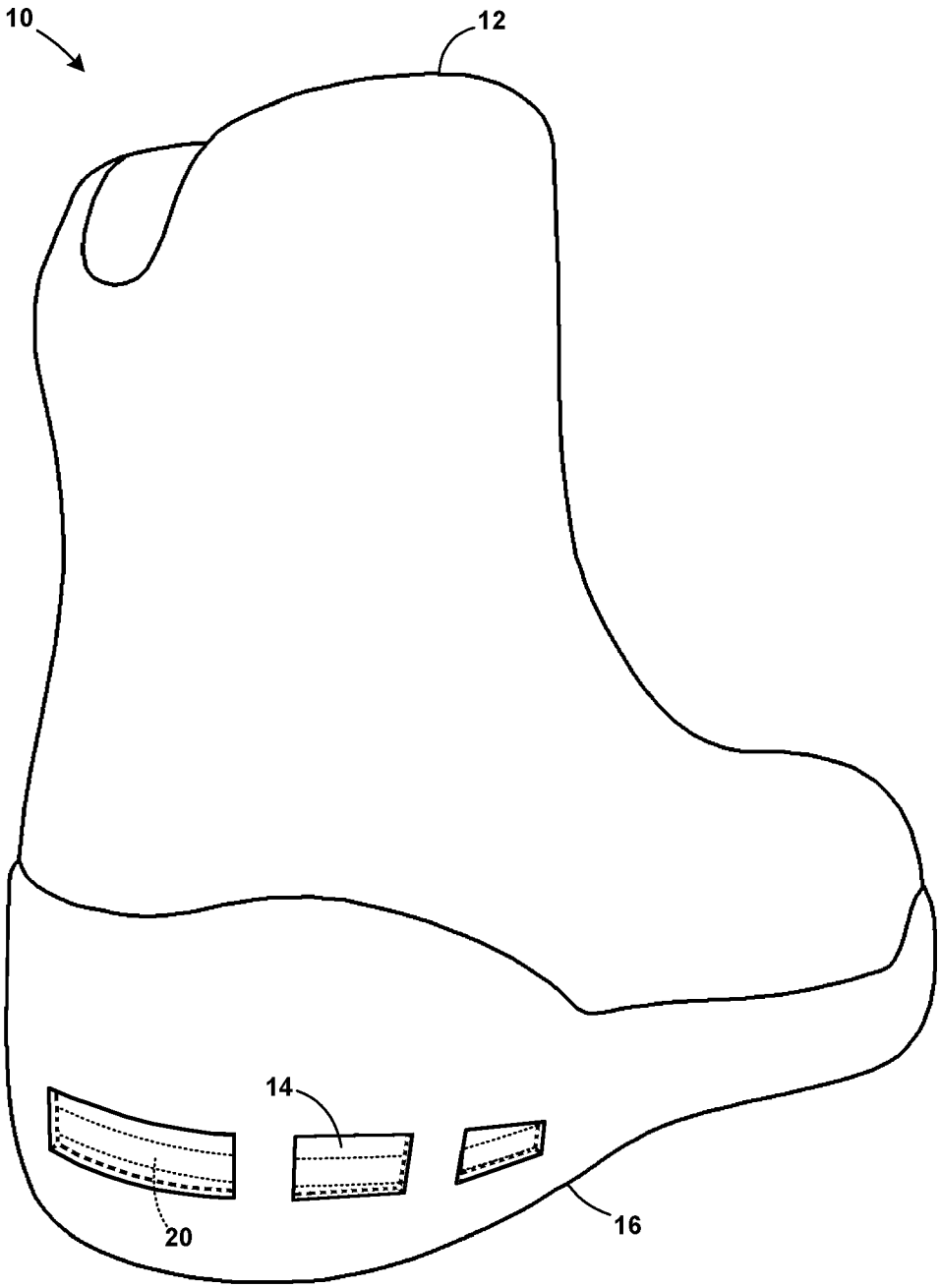
FIG. 2 is a rear, lateral, perspective view of another configuration of a boot implementing the present invention.
Figure 3:
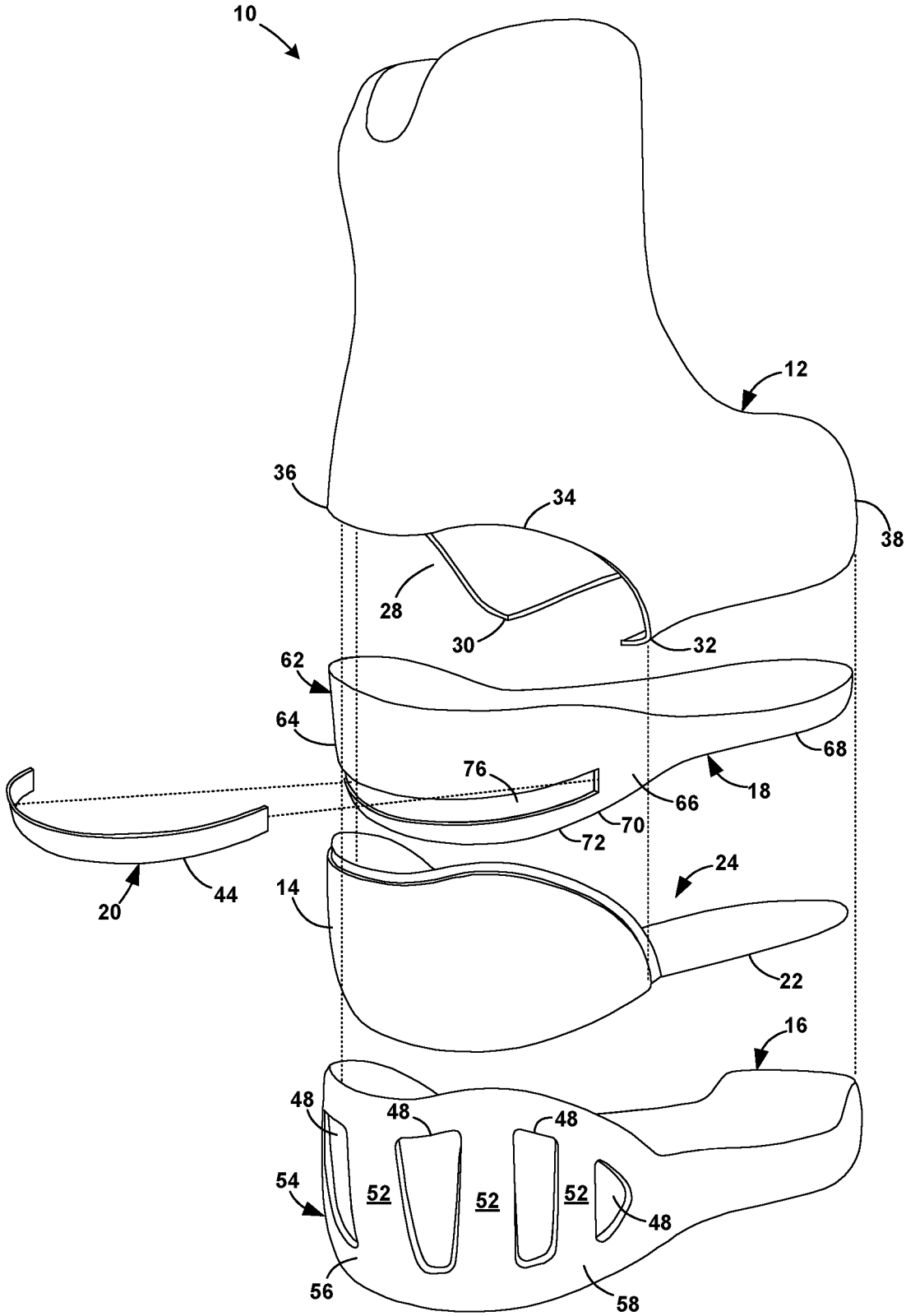
FIG. 3 is an exploded, lateral side view of the boot of FIG. 1.

The present application is a continuation-in-part of U.S. patent application Ser. No. 16/019,673 which, in turn, is based on U.S. Provisional Patent Application No. 62/536,597. Both applications are incorporated herein by reference in their entireties.

The present invention is footwear with a reflective strip on the heel that is positioned low on the back of the outsole rather than the upper and low enough that, under most circumstances, the reflective strip is not covered by the pant leg. Also, the reflective strip is located inside the heel counter, where it is visible through a transparent window, and where it is protected from weather conditions, kept clean, dry, and free from abrasion that can affect its visibility and reflectivity.

The footwear can be a shoe, mid-high shoe, or boot and is referred to as a boot in the remainder of the present specification.

The components of the boot 10, shown in the figures, are an upper 12, a heel counter 14, a Strobel board 22, an outsole 16, a footbed 18, and a reflective strip 20.

The upper 12 is a standard upper with the usual components. It is composed of typical upper materials, for example, leather and synthetic materials.

In the illustrated design, the upper 12 does not cover the heel area. A heel cutout 28 extends from approximately the rear end of the arch 30, through a 90° curve 34 around the back 36 at approximately the height of the toe 38, and down the outside to a point 32 across from the arch 30. In an alternate design, the upper 12 extends down to cover some of the heel area.

In the illustrated design, the heel counter 14 and Strobel board 22 are molded as a single component, referred to hereinafter as the combination 24. The combination 24 has a high heel counter 14 and a forwardly extending Strobel board 22. Typically, the combination 24 is composed of a thermoplastic polyurethane that is relatively stiff at the heel counter 14 but more flexible at the Strobel board 22 so that it can bend for walking.

Alternatively, the heel counter 14 and Strobel board 22 are separate components. Typically, both components 14, 22 are composed of a thermoplastic polyurethane, with the heel counter 14 being relatively stiff for support and the Strobel board 22 being relatively flexible so that it can bend for walking.

The upper 12 is Strobel-stitched to the heel counter 14 and Strobel board 22, as at 46.

Unlike the typical boot, the boot 10 of the present invention does not have separate midsole and insole. It has a footbed 18 that combines the functions and features of both a midsole and an insole. It is two to three times thicker than the typical insole and can be composed of any of a number of different materials known in the art, such as thermoplastic polyurethane (TPU) foam, expanded thermoplastic polyurethane (eTPU) foam, polyurethane (PU) foam, ethylene vinyl acetate (EVA), or combinations thereof. The footbed 18 sits directly on the Strobel board 22. The footbed 18 has a heel cup 62 and a forward section 68 that extends to the toe 38. The present design of the footbed 18 provides superior support, cushioning, and shock absorption for the foot.

The typical midsole is glued into the boot 10 and the typical insole is removable. The footbed 18 of the present design can be either glued into the boot 10 or removable, as discussed below.

The reflective strip 20 is an elongated strip of reflective material. Dimensions are in the range of 2 inches to 5 inches long and ½ inch to 1½ inches high. The thickness typically depends on how reflection is provided and can be from a thin film up to about 3⁄32 inch.

The reflective properties are obtained preferably from retroreflective glass beads or a prismatic material, although the present invention contemplates that any reflective materials can be used. The present invention contemplates that the reflective strip 20 can be any color, for example, white, silver, and other colors. The reflective strip 20 can be fluorescent.

The reflective strip 20 is attached to the outside of the footbed 18 with the reflective side facing out. The reflective strip 20 is attached generally horizontally to the back of the footbed heel cup 62 near the bottom, that is, close to the Strobel board 22. The reflective strip 20 extends around the back surface 64 and, optionally, down the lateral side surface 66 of the heel cup 62 to across the boot 10 from approximately the back of the arch 70. Contemplated methods of attachment are described below.

The outsole 16 is typically composed of carbon rubber, but other durable, flexible materials can be used. The outsole 16 is cemented to and may also be stitched to the upper 12/heel counter 14 assembly.

The reflective strip 20 is visible through the heel counter 14 along at least a substantial portion of the length of the reflective strip 20. In one configuration, shown in FIGS. 7 and 8, at least the portion 82 of the heel counter 14 adjacent to the reflective strip 20 is transparent so that the reflective strip 20 is visible through it. Optionally, the entire heel counter 14 is transparent. Optionally, the transparent portion 82 of the heel counter 14 is tinted while remaining transparent so that the reflective strip 20 is visible through it. The transparent heel counter 14 protects the reflective strip 20 from the ambient environment.

Figure 9:
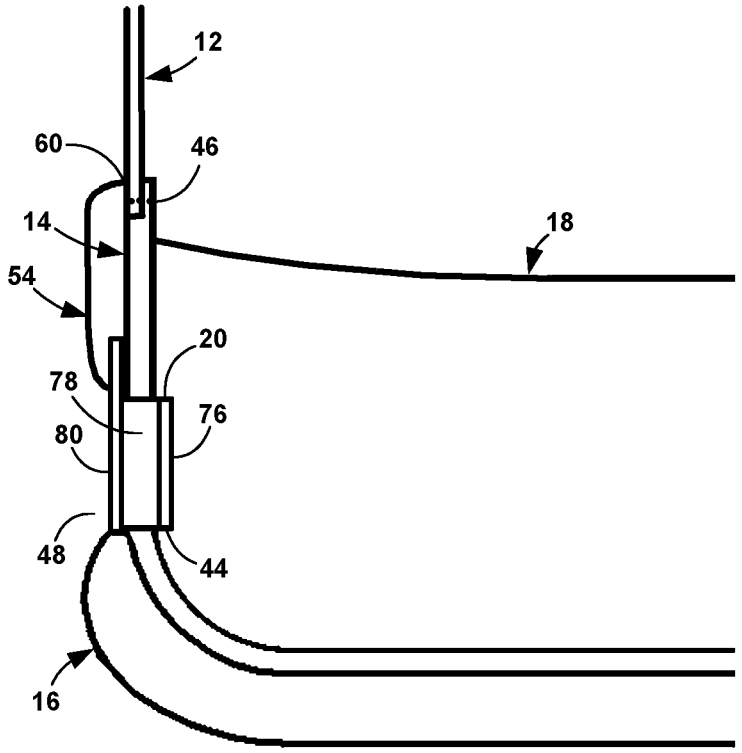
FIG. 9 is a cross-sectional view of another configuration of the heel area.

In the configuration of FIG. 9, the heel counter 14 has a cutout 78 through which the reflective strip 20 is visible. The cutout 78 extends around the heel counter 14, following approximately the same path as the reflective strip 20. Typically, the cutout 78 extends across the back and along the lateral side of the heel counter 14 at approximately the same extent as the reflective strip 20. Optionally, a sheet of transparent protective material 80 is positioned outside of the heel counter 14, as shown in FIG. 9, to protect the reflective strip 20 from the ambient environment.

The reflective strip 20 is positioned low on the footbed heel cup 62 so that it is visible low on the heel of the boot 10. In this position, it is not normally covered by the wearer's pant leg when the wearer is standing. Typically, the bottom edge 44 of the reflective strip 20 will be no more than two inches above the bottom 72 of the footbed 18 and preferably no more than 1½ inches above the bottom 72.

As can be seen in FIGS. 1-4, the heel 54 of the outsole 16 has one or more window cutouts 48 on the back 56 and, optionally, the lateral side 58, that align with the transparent portion 82 or cutout 78 of the heel counter 14. If there are more than one window cutout 48, they are separated by ribs 52 that provide stability and robustness to the outsole 16. The window cutouts 48 of the outsole 16 must be low enough on the outsole heel 54 to align with the reflective strip 20 to make the reflective strip 20 visible through the window cutout 48 from outside the outsole 16. The height of the window cutouts 48 is such that at least a substantial portion of the height of the reflective strip 20 is visible through them.

Figure 7:
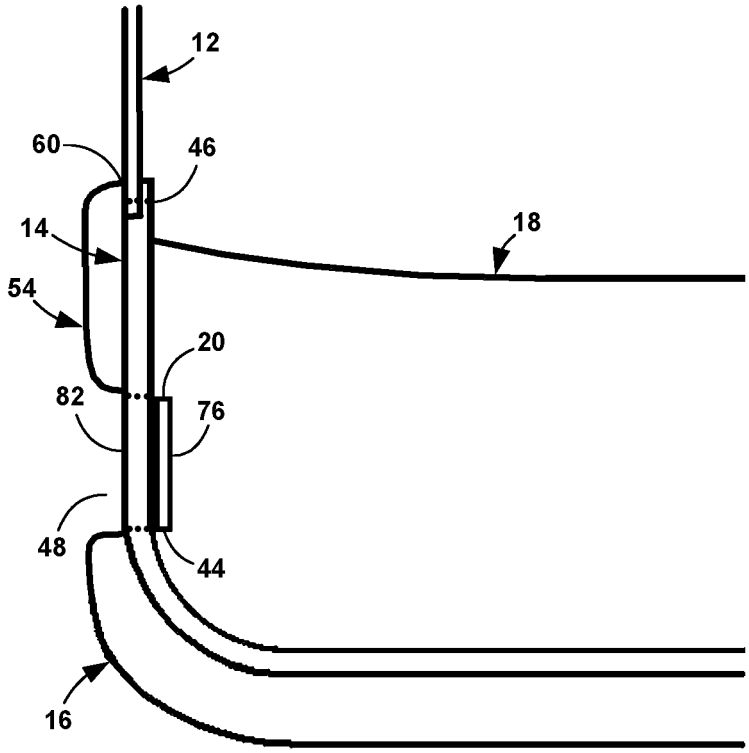
FIG. 7 is a cross-sectional view of one configuration of the heel area.

The transparent portion 82 of the heel counter 14 can have several different configurations. In the configuration of FIG. 7, the portion 82 of the heel counter 14 adjacent to the reflective strip 20 is flush with the rest of the heel counter 14. In other words, the portion 82 of the heel counter 14 adjacent to the reflective strip 20 is recessed within the outsole window cutouts 48.

Figure 4:
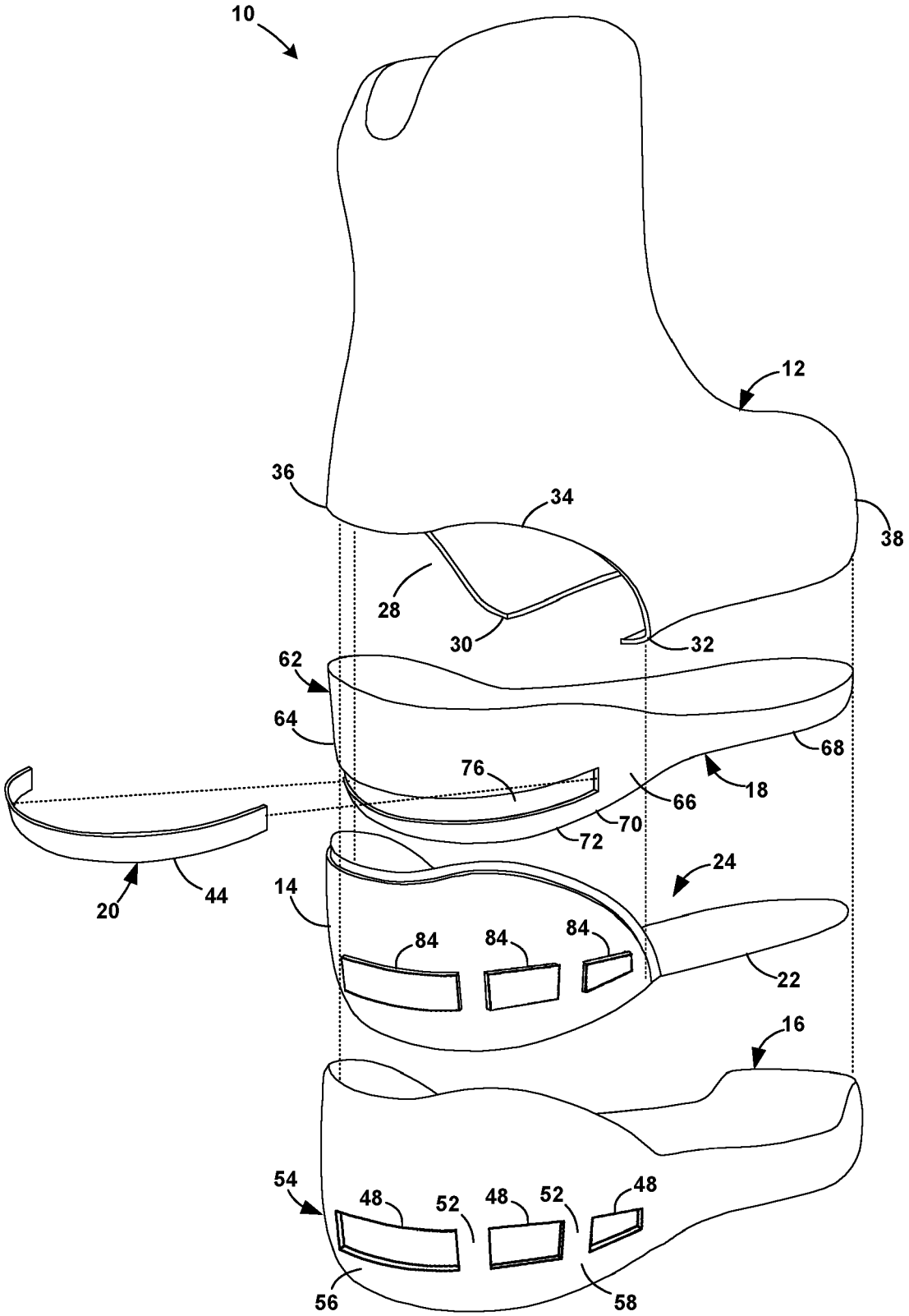
FIG. 4 is an exploded, lateral side view of the boot of FIG. 2.
Figure 5:
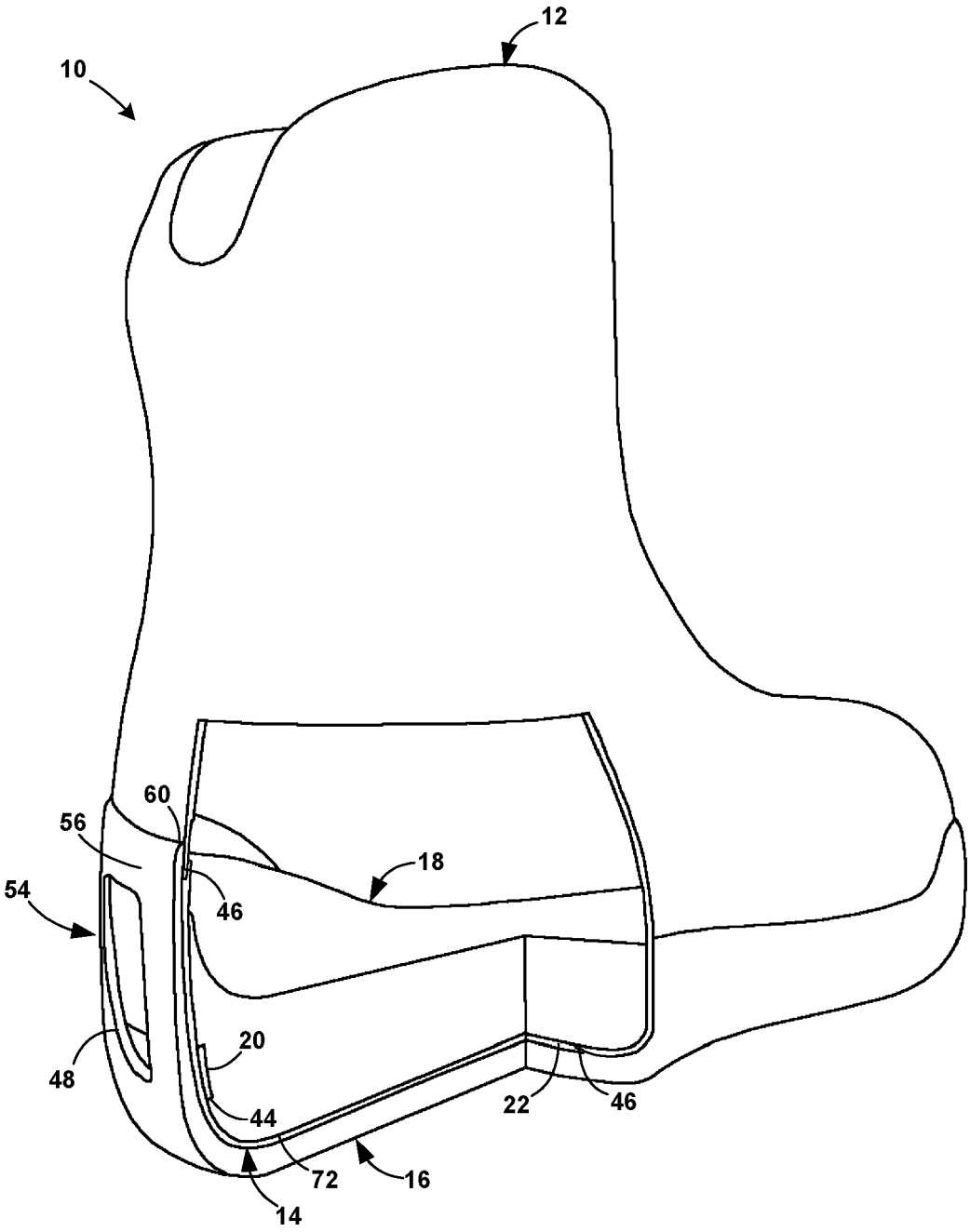
FIG. 5 is cut-away view of the heel area of the boot of FIG. 1.
Figure 6:
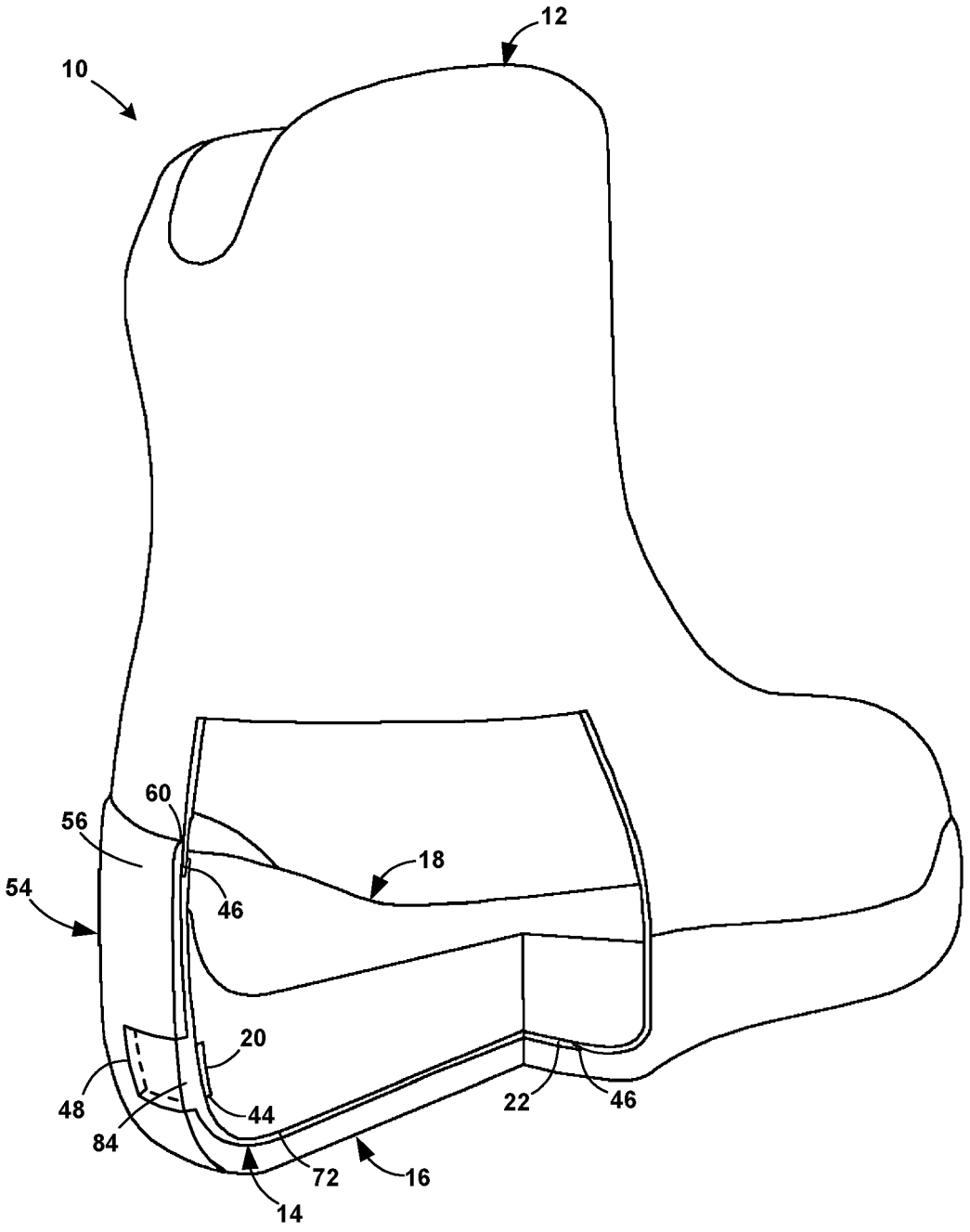
FIG. 6 is cut-away view of the heel area of the boot of FIG. 2.
Figure 8:
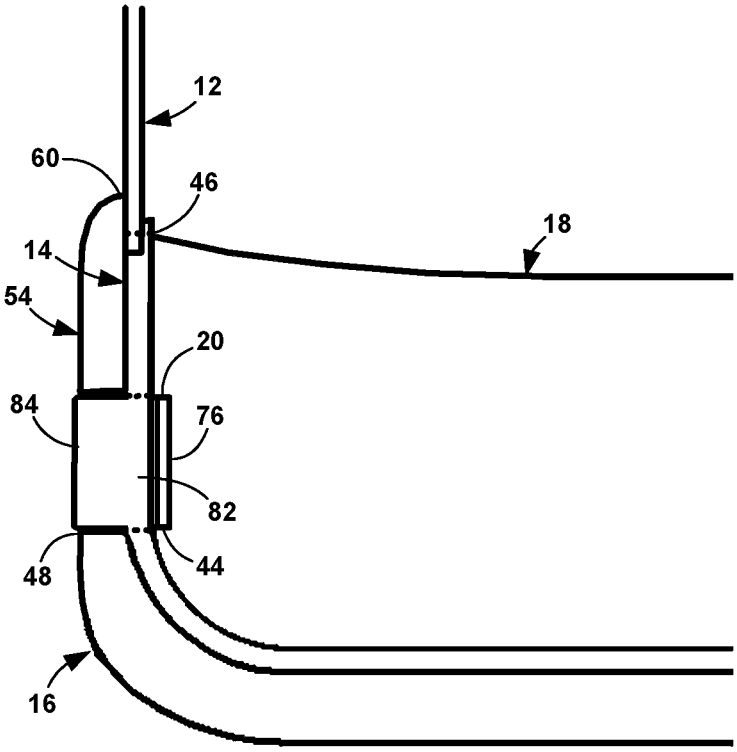
FIG. 8 is a cross-sectional view of another configuration of the heel area.

In the configuration of FIGS. 4, 6 and 8, the portion 82 of the heel counter 14 adjacent to the reflective strip 20 is raised relative to the rest of the heel counter 14, as at 84. The perimeter of the raised section 84 is the same as the corresponding outsole window cutout 48 so that it fills the corresponding window cutout 48. There is a raised section 84 for each window cutout 48. The raised sections 84 can be flush with the outer surface 86 of the outsole 16 or extend slightly outside of the outer surface 86, as in FIG. 8. Filling the window cutout 48 keeps dirt, mud, and other foreign matter from filling the window cutout 48 that would otherwise obscure the reflective strip 20.

The reflective strip 20 can be either permanently or replaceably attached to the footbed heel cup 62. The reflective strip 20 can be permanently attached in any number of ways. One way is to glue the reflective strip 20 to the heel cup 62. The reflective strip 20 can be glued to the back surface 64 of the heel cup 62 or it can be glued into a shallow, horizontal depression 76 extending around the back 64 and lateral side 66 of the heel cup 62 in order to maintain a smooth outer surface to the footbed 18.

Another permanent attachment method involves molding the reflective strip 20 into the footbed heel cup 62. Another permanent attachment method is to retain the reflective strip 20 in place by permanently attaching the footbed 18 in the boot 10, as described below. Any other methods of permanent attachment are contemplated by the present invention.

The reflective strip 20 can be removably attached to the footbed heel cup 62 by any adequate method. In one, the reflective strip 20 is inserted into a shallow, horizontal depression 76 extending around the back 64 and lateral side 66 of the heel cup 62. The reflective strip 20 is retained in the depression 76 by installing the footbed 18 in the heel counter 14, whereby the heel counter 14 presses the reflective strip 20 into the depression 76. The depression 76 retains the reflective strip 20 in the correct position.

Optionally, the reflective strip 20 can be removably secured in the depression 76 by friction, whereby the depression 76 is slightly smaller than the reflective strip 20 and the resilience of the footbed material hugs the reflective strip 20 in the depression 76.

In another removable attachment method, the reflective strip 20 can be attached to the footbed heel cup 62 by a temporary peel-off adhesive.

A removable attachment permits the user to remove and replace the reflective strip 20 as desired. For example, the reflective strip 20 can be installed for nighttime or poor weather use and removed when the sun is out. Additionally, the reflective strip 20 can be replaced with reflective strips of different colors or reflective qualities or if the reflective strip 20 no longer functions adequately.

The footbed 18 is permanently or removably installed in the boot 10. If the reflective strip 20 is not intended to be replaceable, the footbed 18 can be permanently installed by, for example, adhesive. This will also permanently retain the reflective strip 20 between the footbed 18 and the heel counter 14.

If the reflective strip 20 is to be replaceable, the footbed 18 is removable and is retained in the boot 12 by friction.

Public safety personnel, especially police officers, need to have the option of being visible or not. For example, they may want visibility protection during routine traffic stops or while on foot patrol but may want to hide the reflective option during civil unrest or criminal warrant, search, and apprehension activities. The option is available with the boot of the present invention in one of two ways. The first is by removing or installing the removable reflective strip 20 in the removable footbed 18. The other is by installing one of two removable footbeds 18, where one footbed 18 has the reflective strip 20 and the other footbed 18 does not.

Thus, it has been shown and described footwear with a reflective heel. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A boot with a reflective heel comprising:

(a) a footbed having a heel cup with a back surface, a lateral surface, and a bottom;

(b) an elongated reflective strip directly attached generally horizontally to the back surface of the footbed heel cup, a bottom edge of the reflective strip being no more than two inches above the bottom of the footbed, the reflective strip having retroreflective glass beads or a prismatic material for reflectivity;

(c) a heel counter outside the footbed heel cup, the reflective strip being visible through the heel counter;

(d) an outsole outside the heel counter, the outsole having one or more window cutouts through which the reflective strip is visible; and (e) an upper attached to the outsole.

2. The boot of claim 1 wherein the reflective strip extends along the lateral surface of the footbed to a point approximately across from the back of the arch.

3. The boot of claim 1 wherein the bottom edge of the reflective strip is no more than 1½ inches above the bottom of the footbed.

4. The boot of claim 1 wherein the reflective strip is attached within a shallow depression in the footbed.

5. The boot of claim 1 wherein the reflective strip is visible through a transparent portion of the heel counter.

6. The boot of claim 1 wherein the reflective strip is visible through raised transparent portions of the heel counter that fill the outsole window cutouts.

7. The boot of claim 1 wherein the reflective strip is permanently attached to the footbed.

8. The boot of claim 1 wherein the footbed is removable and the reflective strip is replaceably attached to the footbed.

9. A boot with a reflective heel comprising:

(a) a footbed having a heel cup with a back surface, a lateral surface, and a bottom;

(b) an elongated reflective strip directly attached generally horizontally in a shallow depression in the back surface of the footbed heel cup and extending along the lateral surface of the footbed to a point approximately across the boot from the back of the arch, the depression being no more than 1½ inches above the bottom of the footbed the reflective strip having retroreflective glass beads or a prismatic material for reflectivity;

(c) a heel counter outside the footbed heel cup, the reflective strip being visible through a transparent portion of the heel counter;

(d) an outsole outside the heel counter, the outsole having a plurality of window cutouts through which the reflective strip is visible, the transparent portion of the heel counter being raised to fill the window cutouts; and (e) an upper attached to the outsole.

10. The boot of claim 9 wherein the reflective strip is permanently attached to the footbed.

11. The boot of claim 9 wherein the footbed is removable and the reflective strip is replaceably attached to the footbed.

* * * * *